US006923585B2

(12) United States Patent
Mann et al.

(10) Patent No.: US 6,923,585 B2
(45) Date of Patent: Aug. 2, 2005

(54) HYBRID SET-TOP BOX AND PRINTING DEVICE

(75) Inventors: Michelle A. Mann, San Diego, CA (US); Mark A. Hay, Poway, CA (US); Warren S. Catchpole, Corvallis, OR (US); Christopher S. Magirl, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/686,211

(22) Filed: Oct. 15, 2003

(65) Prior Publication Data

US 2004/0075729 A1 Apr. 22, 2004

Related U.S. Application Data

(62) Division of application No. 09/360,726, filed on Jul. 27, 1999, now Pat. No. 6,652,174.

(51) Int. Cl.[7] ..... B41J 29/02

(52) U.S. Cl. ..... 400/691; 400/625; 400/692; 400/693; 347/37; 347/108

(58) Field of Search ..... 400/691, 692, 400/693, 624, 625; 347/104, 108, 37

(56) References Cited

U.S. PATENT DOCUMENTS

| | | | | | |
|---|---|---|---|---|---|
| 5,305,183 | A | * | 4/1994 | Teynor | 361/686 |
| 5,651,625 | A | * | 7/1997 | Smith et al. | 400/691 |
| 5,838,338 | A | * | 11/1998 | Olson | 347/8 |
| 6,064,449 | A | * | 5/2000 | White et al. | 348/732 |
| 6,120,201 | A | * | 9/2000 | McKay et al. | 400/691 |
| 6,203,133 | B1 | * | 3/2001 | Tanaka et al. | 347/15 |
| 6,454,476 | B1 | * | 9/2002 | Negatu et al. | 400/636 |
| 6,588,869 | B1 | * | 7/2003 | Batra et al. | 347/3 |
| 6,652,174 | B1 | * | 11/2003 | Mann et al. | 400/691 |

* cited by examiner

*Primary Examiner*—Ren Yan
*Assistant Examiner*—Kevin D. Williams

(57) ABSTRACT

The present invention is a set-top box integrated with a low-height printer. The printer includes an input tray for storing input media sheets and an output area for holding output media sheets. The printer further includes a printhead that scans and prints on the media sheets from the front to the back of the printer. The media sheets are stored in the input tray in a landscape orientation and are held in the output area in a semi-curled position. Alternatively, the media sheets are stored in the input tray in a portrait orientation.

12 Claims, 5 Drawing Sheets

HYBRID SET-TOP BOX AND PRINTING DEVICE

This is a divisional of application Ser. No. 09/360,726, filed on Jul. 27, 1999, now U.S. Pat. No. 6,652,174.

BACKGROUND OF THE INVENTION

1. Field of the Invention

The invention relates generally to printers, and more particularly, to a low profile printer integrated within a digital set-top box.

2. Related Art

Set-top boxes such as cable television boxes, Internet terminal boxes etc. are increasingly being used with consumer home entertainment equipment such as television sets. For example, most "pay for" broadcast services that use television interaction, such as cable television services and Internet access services via the television, require their users to have some type of set-top box. Note that the term "broadcast services" refers to signals being transmitted over analog telephone lines, coaxial cable lines, fiber optic lines, satellites and the like.

The set-top box typically allows the user to select between channels, perform programming functions, etc. Also, for efficient broadcast transmission and, in some cases, to ensure that only paying customers are using these services, the broadcast signals are usually scrambled or encoded before being transmitted and the set-top box decodes the signals. Consequently, television set-top boxes are becoming an integral part of home entertainment equipment.

There are many instances when a user may want a hardcopy of the information displayed on the screen of their television set. For example, a user may want to print e-mail messages, maps, recipes and information-rich content, such as still or captured scenes from a live broadcast, digital video disk (DVD) players, movie cameras, video recorders etc.

Currently, conventional printers are manually connected to the set-top box when users desire hard copies of the information displayed on the screen of their television sets. However, most conventional printers are bulky, and thus require large amounts of space in users' home entertainment units. Also, expensive and additional cables are required to connect the printer to the set-top box. Further, most conventional printers are not aesthetically appealing like entertainment equipment. This is because most printers are not designed to be used with an entertainment center, but are instead designed to be used with other office equipment. As such, most printers do not match well with other home entertainment equipment.

Thus, what is needed is a set-top box with an integrated low-height printer that will save space in home entertainment units. What is also needed is a printer that will blend in with ordinary home entertainment equipment and will not require the use of exposed and expensive printer cables.

SUMMARY OF THE INVENTION

To overcome the limitations of the systems and methods described above, and to overcome other limitations that will become apparent upon reading and understanding the present specification, the present invention is embodied in a set-top box having an integrated printer. The printer is preferably a low-height printer and includes front and back portions, an input tray for storing input media sheets, an output area for holding output media sheets and a printhead for printing information on the media sheets. The printhead prints information on the media by sequentially scanning the printhead across the media as the media is advanced toward the output area (each scan is commonly referred to as a swath). The printer preferably accepts any standard media, such as 8.5×11 inch (letter size), 8.5×14 inch (legal size), A4, A5, etc papers.

In one embodiment, the paper is stored in the input tray in a portrait orientation so that the shortest dimension of the paper exists from the front to the back of the printer. For example, for 8.5×11 inch paper, the 8.5 inch dimension would exist from the front to the back of the printer and the 11 inch dimension would exist from one side to the other side of the printer. The paper is advanced to the output area in a portrait orientation. Thus, the printhead scans from the front to the back of the printer and each swath is printed across the shortest dimension of the paper.

In another embodiment, the paper is stored in the input tray in a landscape orientation so that the longest dimension of the paper exists from the front to the back of the printer. For example, for 8.5×11 inch paper, the 11 inch dimension would exist from the front to the back of the printer and the 8.5 inch dimension would exist from one side to the other side of the printer. The paper is advanced to the output area in a landscape orientation. Thus, the printhead scans from the front to the back of the printer and each swath is printed across the longest dimension of the paper.

As a result, in both embodiments, the printhead moves from the front to the back of the box when scanning and printing on the media sheets. Further, to reduce the side to side width of the low-height printer, the output media sheets are held in the output area in a semi-curled position. Unlike some conventional inkjet printers that use a U-shaped path, the present printer uses a straight through path from the input tray to the output holding area. This allows the height of the set-top box to be kept to a minimum.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings, which form a part hereof, and in which is shown by way of illustration a specific embodiment in which the invention may be practiced. It is to be understood that other embodiments may be utilized and structural changes may be made without departing from the scope of the present invention.

Overview

Figure 1:
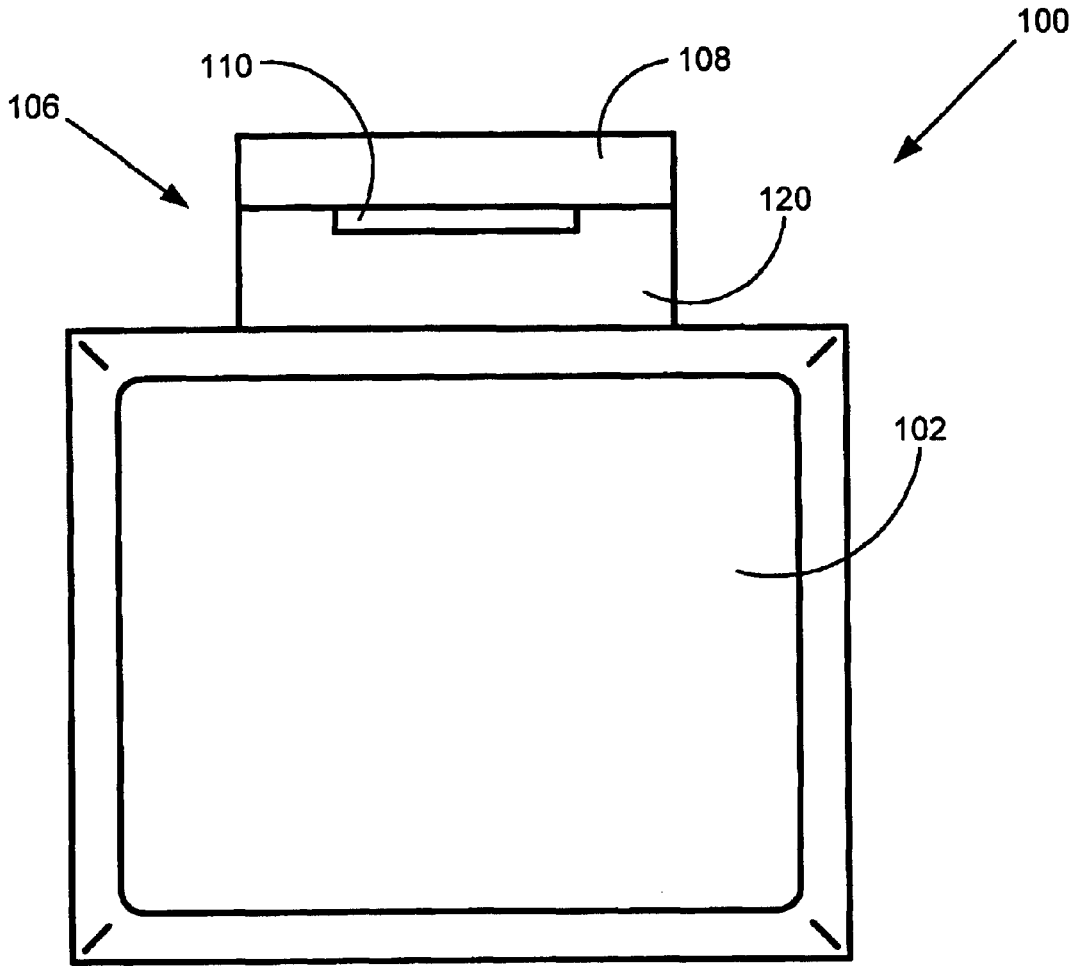
FIG. 1 is a block diagram of a hybrid printer and set-top box.

As shown in the drawings for the purposes of illustration, FIG. 1 depicts an overview block diagram of a home entertainment system 100 of the present invention. Namely, the system 100 includes a television set 102 and a home entertainment unit or a hybrid printer and set-top box 106. The hybrid printer and set-top box 106 can be positioned near or on top of the television set 102 and contains a set-top box 108, set-top box electronics 110 and a print mechanism 120. The set-top box electronics 110 electronically connects the print mechanism 120 via any suitable manner, such as an electrical cable (not shown), to the set-top box 108. The set-top box electronics 110 is also connected to the television set 102 via any suitable manner, such as a coaxial cable (not shown).

The set-top box electronics 110 contains at least a processor or controller (not shown) to process data. Depending on the set-top box, processing data may include decoding encoded data, processing data from the Internet and processing data that is to be printed by the print mechanism 120. Thus, the set-top box electronics 110 may include both conventional set-top box electronics and printer electronics.

The set-top box electronics 110 can also contain a non-volatile memory (not shown) for storing software programs to run the print mechanism 120 (i.e., a printer driver) and to decode encoded data (i.e., decoding algorithm) or to access and interpret data from the Internet (i.e., a web browser). As will be explained later, the print mechanism 120 may have a partner electronics connector or electronic port to electronically couple audio/visual equipment, such as a video camera, video recorder, DVD player and the like to the hybrid printer set-top box. The partner electronics port may also be used to download needed software to the set-top box electronics 110. That is, software upgrades as well as new software (e.g., video capture software) may be downloaded into the set-top box electronics 110 via the partner electronics port.

However, currently, for printing purposes, problems exist when a user desires a hard copy of the information displayed on the television screen. Although conventional printers can be manually connected to some set-top boxes, most conventional printers are bulky, and thus require large amounts of space in users' home entertainment units. In addition, most conventional printers do not match the decor of entertainment equipment.

The hybrid set-top box with an integrated low-height printer in accordance with the present invention solves these problems. One advantage of the present invention is that the cost of manufacturing for the hybrid set-top box and printer is reduced. Namely, the hybrid set-top box and printer shares a single, albeit slightly larger, power supply device. Ordinarily, the cost of two individual power supply devices is greater than the cost of one device. In addition, the hybrid set-top box and printer shares a common top-case material. As is well known in the industry, top-case materials are typically expensive components. Further, the hybrid set-top box and printer allows for the full integration of the printer electronics onto the set-top box electronics board. This will additionally contribute to more cost savings. Part of these manufacturing cost savings will likely be passed along to the users in the form of reduced prices for the hybrid box.

Another advantage is that the hybrid set-top box and printer can be manufactured to match the style and decor of typical home entertainment equipment. In addition, since the set-top box and printer of the present invention is an integrated hybrid device, it saves space in users' home entertainment centers.

Component Details and Operation:

Landscape Print Mechanism

Figure 2:
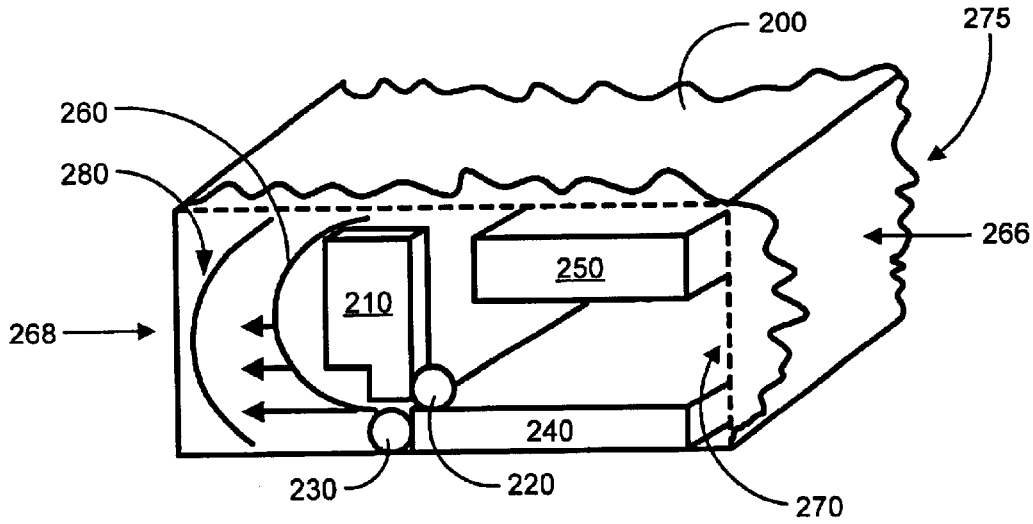
FIG. 2 illustrates a cut-away perspective view of a front portion of one embodiment of the present invention.

FIG. 2 illustrates one embodiment of the present invention, namely a print mechanism of the hybrid set-top box printer 106 of FIG. 1. The print mechanism of FIG. 2 is a landscape print mechanism 200 depicted by a cut-away front perspective view. The landscape print mechanism 200 includes a printhead 210, a pick and feed roller 220, a print bar 230, an input tray 240 and partner electronics, preferably including an interconnection port 250 (hereinafter collectively referred to as "partner electronics/port 250"). As previously mentioned, the partner electronics/port 250 can be used to electronically couple additional equipment to the hybrid printer and set-top box. The partner electronics/port 250 can further be used to upgrade software used to operate the set-top box. The partner electronics/port 250 may be located on either the top of the box or on any of the sides of the box. There may also be a plurality of partner electronics/ports 250.

A plurality of media sheets 260 are stored, one atop another, in the input tray 240. To ensure that the width of the hybrid set-top box and printer meets standard width specifications of home entertainment equipment, such as 430 mm, an output tray is preferably not used. Instead, output media sheets 260 are pushed or kicked in the output area of the hybrid set-top box and printer in the direction shown by the arrows.

In addition, to further ensure that the 430 mm width specification is met, the media sheets 260 are preferably stored in the input tray 240 in a landscape orientation so that the shortest dimension (width) of the paper exists from one side 266 to the other side 268 of the printer 200, as shown in FIG. 2. Hence, the media sheets 260 are also held in the input tray 240 in a landscape orientation. For example, for 8.5×11 inch paper, the 8.5 inch dimension (width) would exist from side 266 to side 268 of the printer 200 and the 11 inch dimension (length) would exist from a front 270 to a back 275 of the printer 200.

In operation, the input tray 240 may be suitably lifted by an automatic lifter or resiliently biased against the pick and feed roller 220 by a spring to allow the pick and feed roller 220 to pick the topmost media sheet 260 from the input tray 240. The printing process starts by actuating the pick and feed roller 220 to move the leading edge of the media sheet 260 toward the print bar 230. The actuating mechanism is well known in the art and thus is not described. To allow the printhead 210 to print on the media sheet 260, the sheet is stopped momentarily in a print zone (not shown).

When printing on the media sheet 260, the printhead 210 scans the media sheet 260 on an axis from the front 270 to the back 275 of the printer 200 and the paper is advanced by the roller 220 to an output area 280 in a landscape orientation. In other words, as the printhead 210 scans from the front 270 to the back 275 of the printer 200, each swath of ink is printed across the longest dimension of the paper. After information is printed on the media sheet 260, the media sheet 260 is kicked or pushed into the output area 280. The output area preferably has a curved track for holding the outputted paper in a semi-curled position for saving space.

Portrait Print Mechanism

Figure 3:
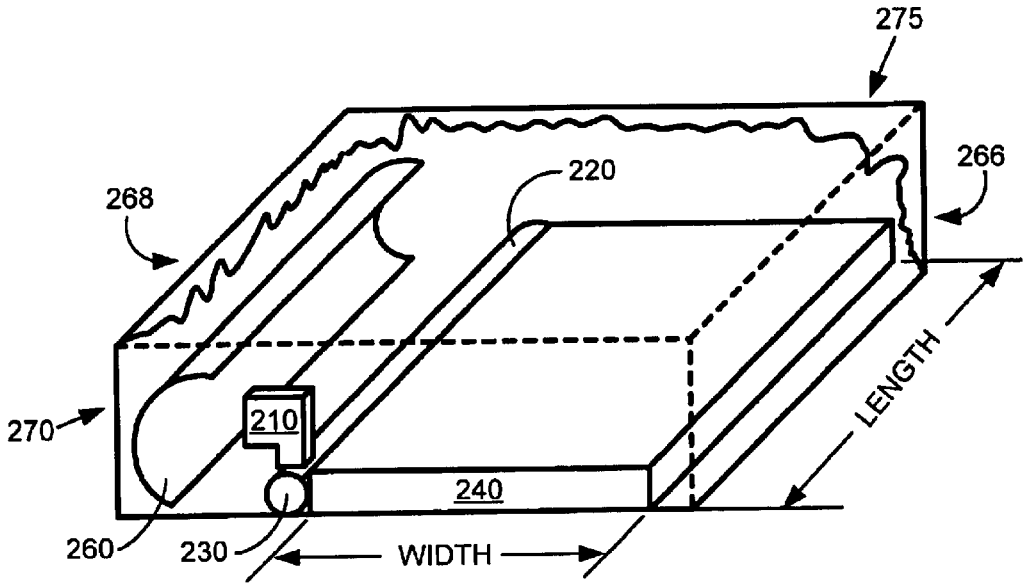
FIG. 3 depicts a cut-away perspective view of one embodiment of the present invention.
Figure 4:
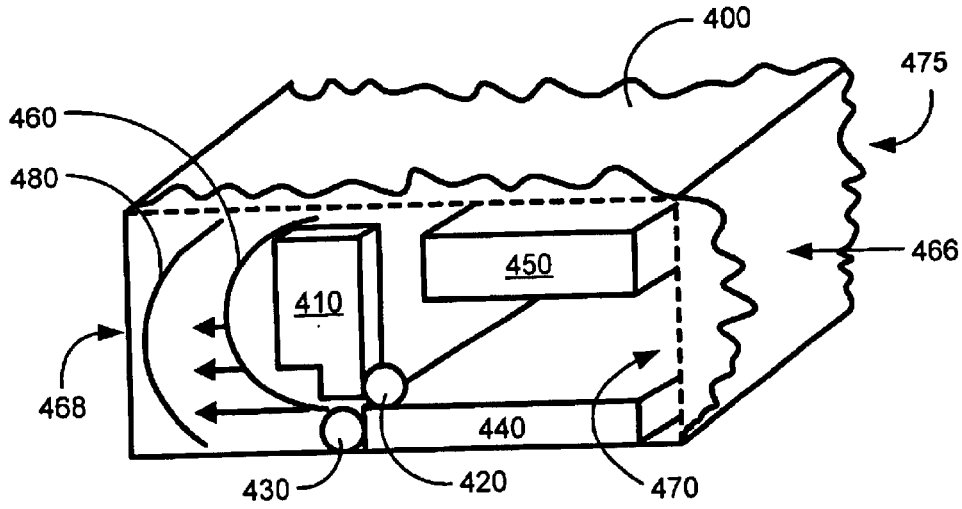
FIG. 4 illustrates a cut-away perspective view of another embodiment of the present invention.
Figure 5:
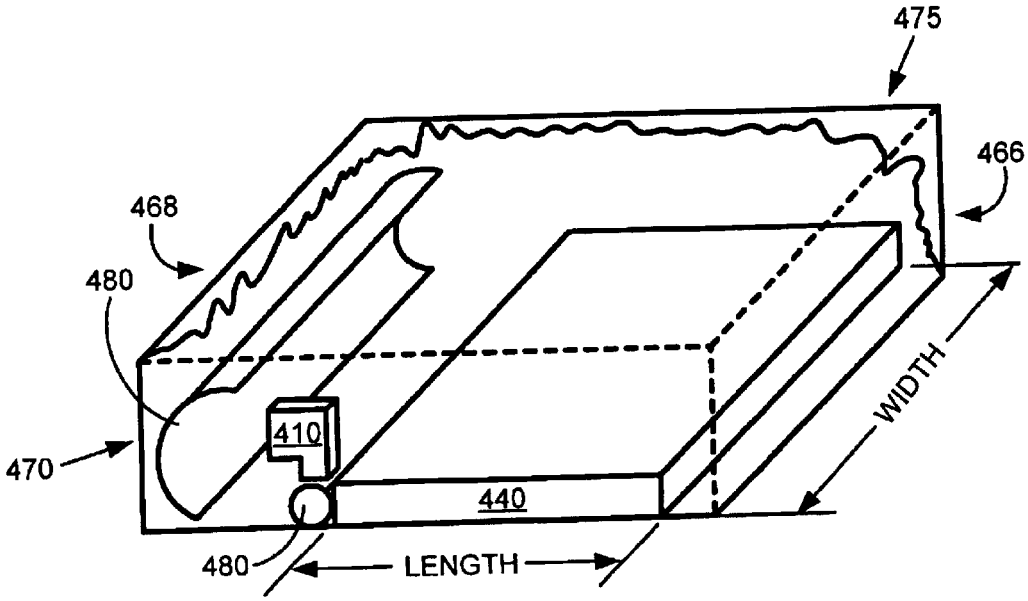
FIG. 5 depicts cut-away perspective view of the embodiment of FIG. 4 of the present invention.

FIGS. 4 and 5 illustrate another embodiment of the present invention. FIGS. 4 and 5 are identical to FIGS. 2 and 3, respectively, with the exception of input tray 440, which is disposed in a portrait orientation (see FIG. 5). The configuration of FIG. 5 allows the hybrid set-top box and printer 106 of FIG. 1 of the present invention to have a reduced depth.

Similar to FIGS. 2 and 3, FIGS. 4 and 5 show a plurality of media sheets 460 stored, one atop another, in input tray 440 of printer 400. Output media sheets 460 are pushed or kicked into output area 480 of the hybrid printer and set-top box in the direction shown by the arrows. As in the embodiment of FIG. 2, an output tray is not used. Instead, output media sheets 460 are held in the output area 480 in a semi-curled position. This configuration ensures that specific width specifications of home entertainment equipment is also met in this embodiment.

In operation, the input tray 440 may also be lifted to allow pick and feed roller 420 to pick the topmost media sheet 460 from the tray. Similar to printer 200 of FIG. 2, the printing process for printer 400 starts by actuating the pick and feed roller 420 to move the leading edge of the media sheet 460 toward the print bar 430. To allow the printhead 410 to print on the media sheet 460, the sheet is stopped momentarily in a print zone (not shown).

However, in this embodiment, the media sheets 460 are preferably stored in the input tray 440 in a portrait orientation so that the shortest dimension (width) of the paper exists from a front 470 to a back 475 of the printer 400, as shown in FIG. 4. Hence, the media sheets 460 are held in the input tray 440 in a portrait orientation. For example, for 8.5×11 inch paper, the 8.5 inch dimension (width) would exist from the front 470 to the back 475 of the printer 400 and the 11 inch dimension (length) would exist from one side 466 to the other side 468 of the printer 400. The media sheets 460 are fed to the printbar 430 in the same portrait orientation as stored. After information is printed on the media sheet 460, the media sheet 460 is kicked or pushed into output area 480.

Thus, when printing on the media sheet 460, the printhead 410 scans the media sheet 460 on an axis from the front 470 to the back 475 of the printer 400 and the paper is advanced by the roller 420 to the output area in a portrait orientation. In other words, as the printhead 410 scans from the front 470 to the back 475 of the printer 400, each swath of ink is printed across the shortest dimension of the paper.

Media Sheet Access

In both embodiments of FIGS. 2–5, input media sheets are stored in respective input trays. The input trays, as will be explained later may be slid in and out of the hybrid set-top box and printer. Output media sheets may be retrieved, however, in a variety of ways. For example, the output media sheets may be retrieved through an open slot located on top of the box (see FIG. 6) or through an open door on top of the box (see FIG. 7).

Figure 6:
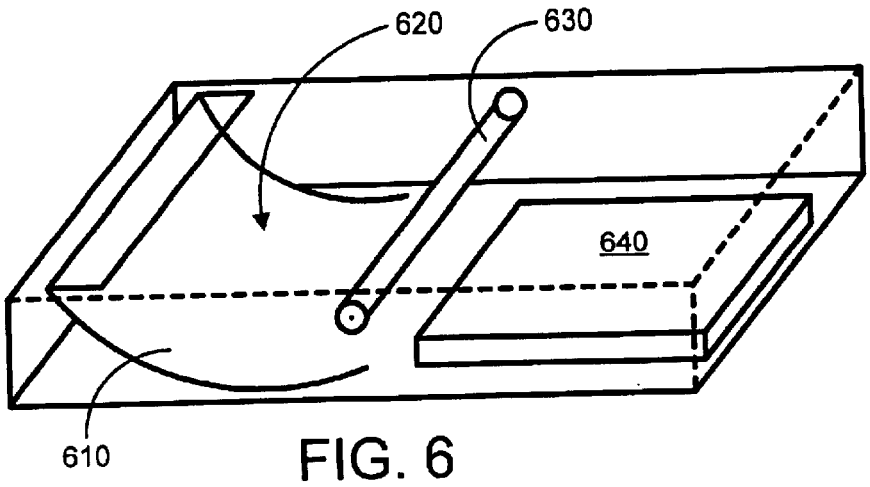
FIG. 6 shows a cut-away perspective view of the present invention with a slot open on top of the set-top box to retrieve output media sheets.
Figure 7:
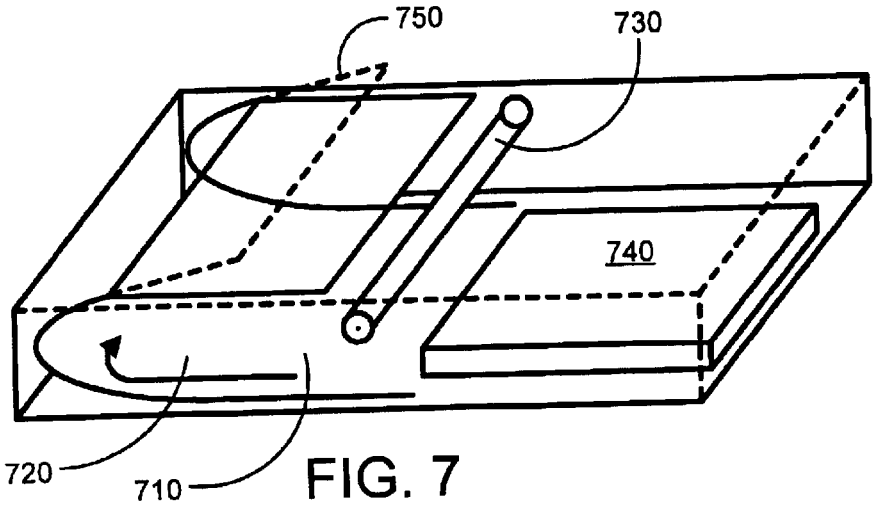
FIG. 7 shows a cut-away perspective view of the present invention with an open top access.

In FIG. 6, the media sheets 610 are shown semi-curled or curved over a track of output area 620, printbar 630 and input tray 640. FIG. 7 shows input area 740, printbar 730, semi-curled media sheets 710 that are curved over a track of output area 720 and door 750. Note that although the invention is shown having top accesses to the output media sheets, it is not restricted to only such accesses, side accesses are equally within the scope of the invention.

Print Mechanism Access

Figure 8:
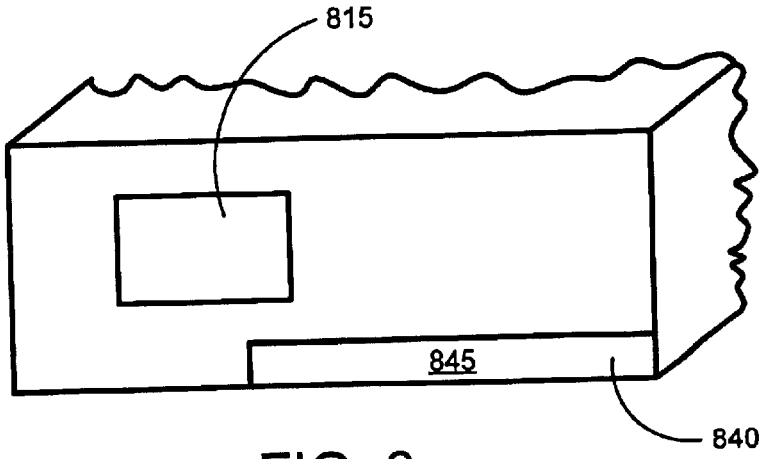
FIG. 8 illustrates sample access to the print mechanism.

FIG. 8 illustrates consumer accesses to the print mechanism. For example, access to the printhead such as to replace ink cartridges can occur through an opening 815 behind the hybrid set-top box and printer front panel. In addition, an input paper tray 840 may be slid in and out of the set-top box through opening 845. Openings 815 and 845 may also be used to clear paper jams. These openings can be placed at the rear as well as atop the box. Also, if the top of the box is not used to store or retrieve media sheets or to provide access to the print mechanism of the present invention, other equipment can be stacked atop the box.

Alternative Embodiments

Figure 9A:
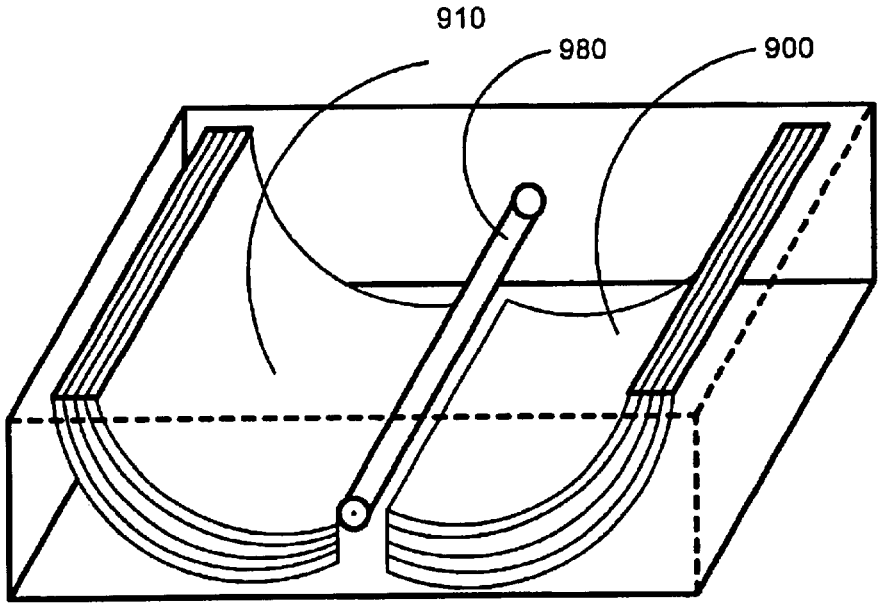
FIG. 9A illustrates a cut-away perspective view of the present invention with slots open at the top of the set-top box.
Figure 9B:
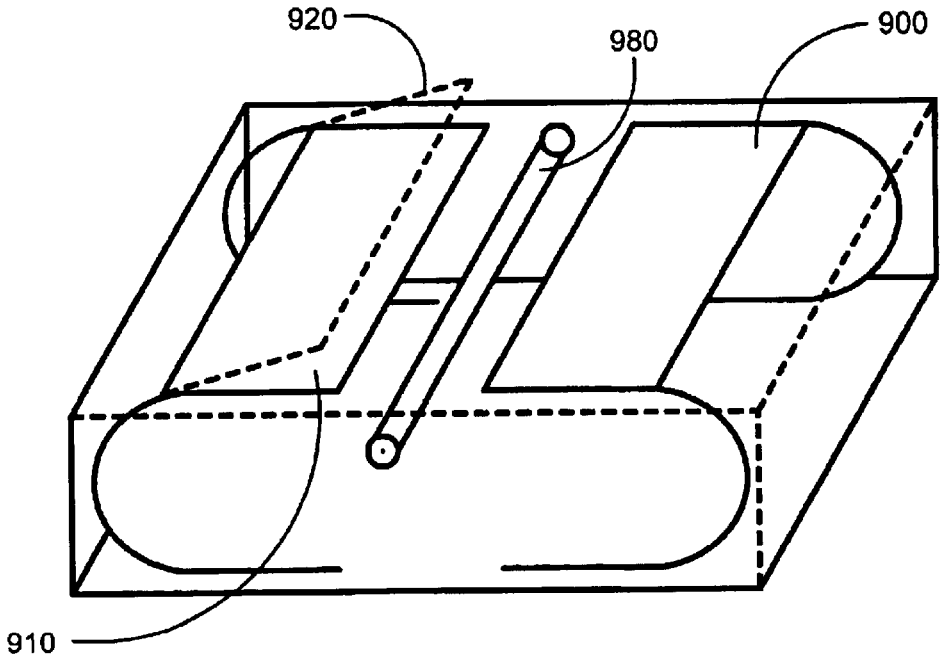
FIG. 9B illustrates a cut-away perspective view of the present invention with door accesses atop the set-top box.

FIG. 9A illustrates a cut-away perspective view of the present invention with slots open atop the set-top box to store input media sheets as well as to retrieve output media sheets. FIG. 9B illustrates a cut-away perspective view of the present invention with door access to store and to retrieve media sheets. As shown, either side of the hybrid set-top box and printer can be used to store the output media sheets. If input media sheets are stored at side 900, the sheets will travel from right to left. If, on the other hand, the input media sheets are stored at side 910, the sheets will travel from left to right.

In either FIG. 9A or FIG. 9B, input and output media sheets are held in a semi-curled or curved up position. This configuration allows for an even more compact set-top box. Note that in both FIGS. 9A and 9B, printbar 980 is shown. Note also that open door access 920 is shown in FIG. 9B.

CONCLUSION

The present invention uses a minimal number of rollers (i.e., the pick and feed roller) and does not stack the output of the printer on top of the input. Thus, the present invention uses a straight through paper path as opposed to the U-shaped paper path of conventional printers. This allows the printhead to be located only one inch above the bottom of the box. The straight through paper path and the low printhead contribute to a low profile hybrid printer and set-top box.

The description of the present invention has been presented for purposes of illustration and description, but is not intended to be exhaustive or limited to the invention in the form disclosed. Many modifications and variations will be apparent to those of ordinary skill in the art. Therefore, the foregoing description should not be taken as limiting the scope of the invention defined by the appended claims.

What is claimed is:

1. A printer comprising:

first internal electronic components physically positioned adjacent to an access area of a set-top box and configured to mate with second internal electronic components of the set top box, wherein the first and second internal electronic components are electrically shared and physically integrated with each other without a cable connection;

an input area capable of holding media sheets, the media sheets having a length and a width, the length having a greater dimension than the width, wherein the length of the media sheets extends from a front to a back of the printer; and a printhead that prints information on the media sheets, wherein the printhead scans and prints on the media sheets along an axis parallel to the length of the media sheets.

2. The printer of claim 1 further comprising:

an output area that holds the media sheets after the printhead prints all required information on the media sheets; and at least one roller capable of advancing the media sheets from the input area to the printhead and from the printhead to the output area.

3. The printer of claim 2 wherein the media sheets are stored in the input area in a tray so that the width of the media sheets extends from the front to the back of the printer and the printhead scans and prints on the media sheets along an axis parallel to the length of the media sheets.

4. The printer of claim 3 wherein the output area has a curved shape.

5. The printer of claim 4 further comprising an open slot for retrieving output media sheets.

6. The printer of claim 5 further comprising a door for retrieving output media sheets.

7. A method for printing information on a media sheet, the media sheet having a length and a width, the length having a greater dimension than the width, the method comprising:

physically positioning first internal electronic components of a printer adjacent to an access area of a set-top box;

mating together the first internal electronic components of the printer and second internal components of the set top box via the access area wherein the first and second internal electronic components are electrically shared and physically integrated with each other without a cable connection;

storing at least one media sheet in an input area;

feeding the media sheet to a printhead; and scanning the printhead on the media sheet along an axis from a front to a back of the input area and parallel to the width of the media sheet.

8. The method of claim 7 further comprising storing output media sheets in a semi-curled up position.

9. The method of claim 8 further comprising:

holding the media sheets in an output area after the printhead prints all required information on the media sheets; and advancing the media sheets from the input area to the printhead and from the printhead to the output area with at least one roller.

10. The method of claim 8 further comprising providing an open slot for retrieving output media sheets.

11. The method of claim 8 further comprising providing a door for retrieving output media sheets.

12. A printer comprising:

first internal electronic components physically positioned adjacent to an access area of a set-top box and configured to mate with second internal electronic components of the set top box, wherein the printer and set top box electrically share, without a cable connection, the first and second internal electronic components, which are physically integrated with each other, during operation of at least one of the printer and the set top box;

an input tray for holding media sheets having a width and a length in a landscape orientation, the length having a greater dimension than the width;

a printhead for scanning and printing across the length of the media sheets in a landscape orientation;

an output area for holding the output media sheets in a semi-curled position; and at least one roller for moving the media sheets from the input tray to the printhead and from the printhead to the output area.

* * * * *